United States Patent [19]

Polster

[11] 4,118,802

[45] Oct. 10, 1978

[54] DISPOSABLE HOODED GARMENT

[76] Inventor: Morton A. Polster, 221 Charing Rd., Rochester, N.Y. 14617

[21] Appl. No.: 792,996

[22] Filed: May 2, 1977

[51] Int. Cl.[2] ..... A41D 9/00

[52] U.S. Cl. ..... 2/84

[58] Field of Search ..... 2/84, DIG. 7, 243 R, 2/114, 88

[56] References Cited

U.S. PATENT DOCUMENTS

| | | | |
|---|---|---|---|
| 2,911,651 | 11/1959 | Nye et al. | 2/84 |
| 3,111,677 | 11/1963 | Artzt | 2/243 R X |
| 3,323,136 | 6/1967 | Beck | 2/88 X |
| 3,736,595 | 6/1973 | Siegmann | 2/DIG. 7 |
| 3,849,803 | 11/1974 | Connors | 2/84 |
| 3,946,443 | 3/1976 | Knight | 2/84 X |

*Primary Examiner*—Doris L. Troutman

[57] ABSTRACT

Disposable hooded garments are made from thin, rectangular shells comprising two layers of plastic or paper fabric which are sealed along two opposite edges. Combinations of sealed, scored, and rendable lines are formed in one or both layers of the material, the shell being separable along the rendable lines to provide hood portions, arms, and appropriate closing means for securing the garments about the head and torso or arms of a wearer. Disclosed are designs for hooded capes, ponchos, and shirts which can be readily dispensed from a roll or box, e.g., by pulling one garment unit away from another along pre-scored separating lines. Means are also provided for storing individual garments in a neat packet for carrying in a purse, pocket, golf bag, etc. until such time as use is required.

18 Claims, 7 Drawing Figures

DISPOSABLE HOODED GARMENT

BACKGROUND OF THE INVENTION

This invention relates to disposable garments and, more particularly, to disposable hooded capes, ponchos and shirts which can be readily dispensed from a roll or a box, e.g., by pulling one unit away from another along pre-scored separating lines.

Such disposable and dispensable garments are well known in the art, being made from thin webs of paper or plastic materials. Such known garments include aprons, bibs, neck towels, barber sheets, cap-like head coverings, and even rain garments with arms and legs. These garments are generally formed in a single layer of material, sometimes folded over on itself, or in a two-layer shell formed either from a flattened tube of material or from two layers sealed along opposite outside edges. Scored or perforated lines are rendable to separate portions of the material to form openings and tie straps. In the case of the rain garment referred to above, a two-layered shell of material is sealed along both sides of a plurality of scored lines, permitting the shell to separate along the scored lines to form the desired arms and legs of the garment.

SUMMARY OF THE INVENTION

The invention herein is an improvement over such prior art, utilizing combinations of sealed, scored, and rendable lines formed in one or both layers of a rectangular shell of plastic or paper fabric to create more sophisticated garments providing hooded coverage for the wearer in the form of disposable capes, ponchos and shirts.

The rectangular shell is either formed from two separate rectangular layers of the fabric, sealed along two opposite outside edges, or from a flattened cylinder of fabric. The garment comprises a head-receiving hood portion and a further portion for receiving and covering other parts of the body of the wearer, these portions being formed by sealing the two layers of the fabric to each other along one or more scored and rendable lines. After removal from a package, roll or box, the portions of the rectangular shell are separated along the scored lines to form the hood and its face opening, as well as the other features of the garment.

According to one embodiment of the invention, the rendable line which is scored in one of the layers and forms the face opening of the hood includes special segments which are rendable to provide closing means in the form of one or more strips of fabric attached to the hood portion and having free ends which can be tied to each other or passed through one or more slits, permitting the hood to be tightened around the head of a wearer. Similar closing means are provided for the cape opening and for the cuffs of the sleeves of the shirt form of garment.

In the preferred embodiment, separate hood-adjusting means are formed by the separation of additional scored and sealed lines near the shoulder segments of the line forming the hood portion.

Perforations are provided in the fabric layers to provide ventilation.

DESCRIPTION OF THE PREFERRED EMBODIMENTS

Figure 1:
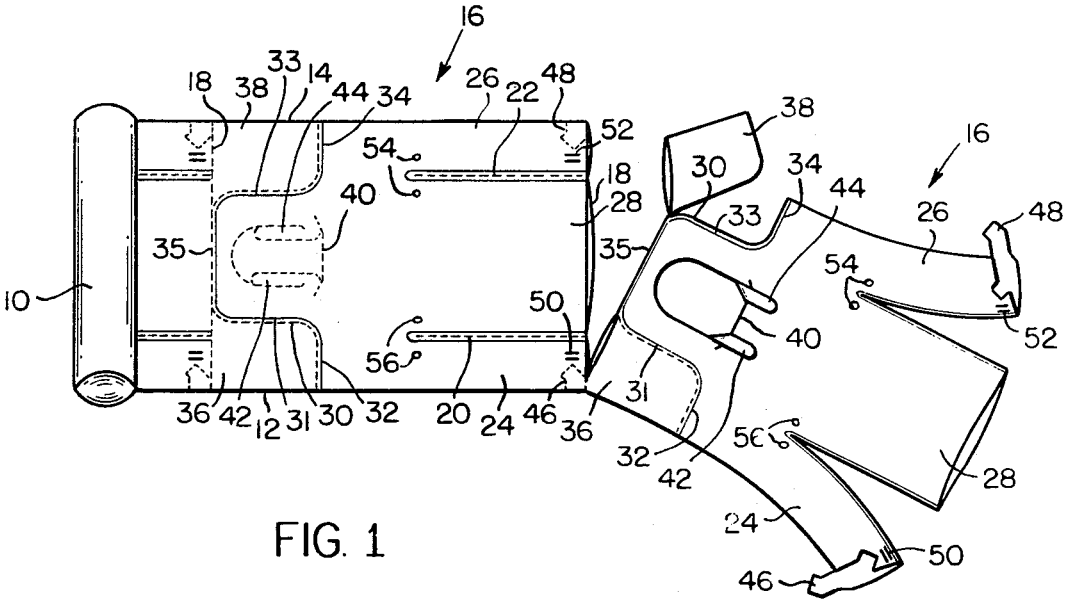
FIG. 1 is a perspective view of a roll of serially connected shirts, one of the shirts being partially separated from the roll and having all of its rendable scored lines separated to form a face opening in the hood portion, ties for adjusting the hood about the head of a wearer, as well as arms with appropriate cuff-closing strips.

Referring to FIG. 1, a plurality of disposable hooded shirts is formed in a continuous roll 10 of suitable fabric, preferably of plastic or paper material. The fabric is preferably in a flattened web of two layers which are sealed along the outside edges 12, 14 of the web.

Each shirt unit 16 is formed from a generally rectangular shell which can be separated from the next succeeding shirt unit by rending the web along line 18 which is scored through both layers of the web. The layers are also sealed together and scored along two sleeve-forming lines 20, 22 which intercept line 18. Each of these sleeve-forming lines is closer, respectively, to an outside edge than each is to the other so that, when the rectangular shell is separated along line 20, 22, two arm-receiving sleeve portions 24, 26 are formed on each side of a trunk-receiving portion 28.

A scored and rendable line 30 is sealed along one side and includes two shoulder segments 32, 34 each extending inwardly, respectively, from a sealed outer edge 12, 14. Line 30 also includes two head segments 31, 33 extending transversely from the respective inner ends of segments 32, 34 and joining in a crown segment 35 coincident with the line 18. When a garment 16 is removed from the roll, the rending of the fabric along line 30 forms a hood portion for the garment, the remnants 36 and 38 being removed.

Another line 40 scored in only one layer of the fabric web and is rendable to form a face-opening for the hood as well as a pair of oppositely disposed strips 42, 44. Each strip is attached to the hood portion of the garment and has a respective free end, the strips being used to tighten the hood around the head of the wearer.

At the cuff of each sleeve, a further scored line 46, 48 is scored in one layer of the fabric web is rendable to form a short strip which, in combination with slits 50, 52 provide closing means to tighten the cuffs about the wrists of a wearer. The width of slits 50, 52 is approximately the same as the width of the narrowest point of the strip formed by the undulations of lines 46, 48. The operation of the cuff-closing means is similar to the operation of the hood-adjusting means described below.

Appropriate ventilation means are provided in the vicinity of the underarms of the wearer in the form of perforations 54, 56.

Figure 2:
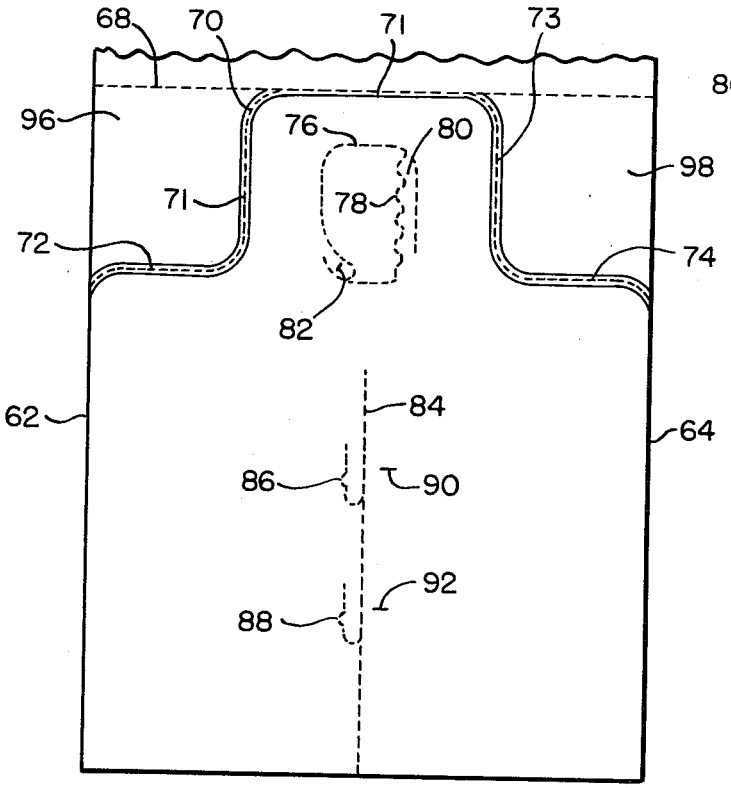
FIG. 2 is a plan view of the end of a roll of serially-connected hooded capes.

Referring now to FIG. 2, a hooded cape garment is shown. Again, the garment is formed from a generally rectangular web of fabric comprising two layers formed by a flattened cylinder or by separate layers sealed along two opposite outside edges 62, 64. The garments are designed to be serially connected, being separable from each other along scored line 68. A further scored line 70 is sealed along both sides and, in addition to a pair of head segments 71, 73 joining in a crown segment 75 coincident with line 68, includes two shoulder segments 72, 74. Line 70 is rendable to form a hood portion in the manner described above in relation to the shirt unit shown in FIG. 1.

Another line 76, again scored only in one layer of the fabric web, is rendable to form the face opening in the hood. Included in this line is an undulating segment 78 which forms a serrated edge for a strip 80 which cooperates with a slit 82 formed on the opposite side of the face opening of the hood to provide hood-adjusting means.

Figure 3:
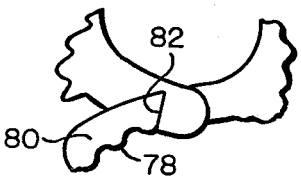
FIG. 3 is a perspective view of the closing strip and slit combination connected together in a manner as it might appear tied beneath the chin of a wearer of the cape shown in FIG. 2.

As can best be seen in FIG. 3, the hood can be tightened around the head of a wearer when strip 80 is passed through slit 82. The size of slit 82 is approximately the same as the narrowest portion of strip 80 between succeeding serrations of edge 78. The additional width of the serrations reduces the tendency of strip 80 to slip out of slit 82, thereby maintaining an adjusted position of the hood without requiring knot tying.

Another rendable line 84, also scored only in one layer of the fabric, is separable to provide a front opening for the cape. This line also includes closing means segments 86 and 88 which cooperate with slits 90 and 92 formed in the trunk-covering portion of the garment for providing means for closing the garment about the body of a wearer.

Figure 4:
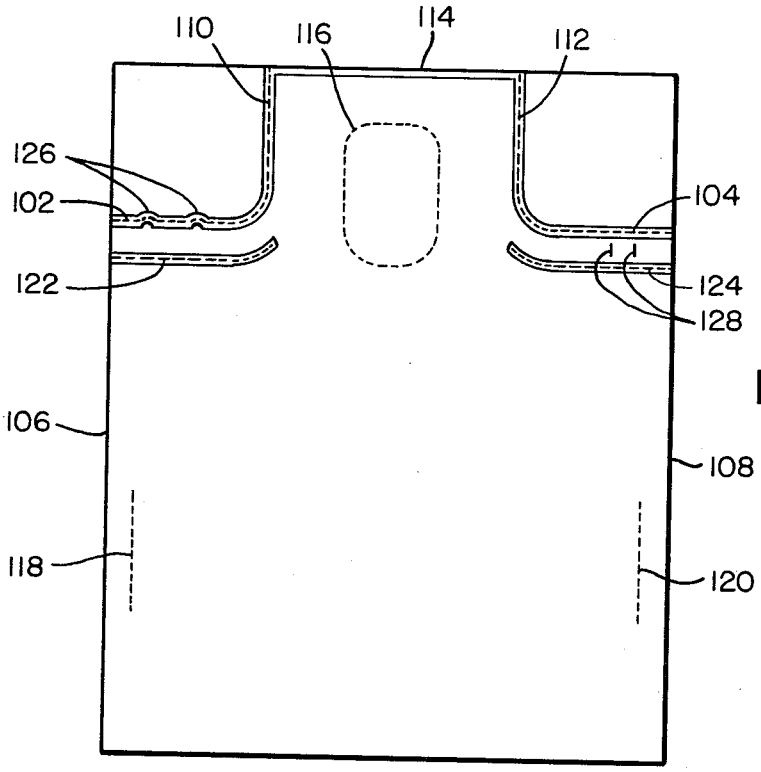
FIG. 4 is a plan view of a rectangular shell having scored and sealed lines separable to form a hooded poncho including the preferred form of hood-adjusting means.

Referring to FIG. 4, a hooded poncho is shown including preferred hood-adjusting means. The hood portion is formed by a rendable line which is sealed along both sides and comprises a pair of shoulder segments 102, 104, each extending inwardly from one of the sealed outside edges 106, 108, and a pair of head segments 110, 112 joining in a crown 114 coincident with the upper edge of the rectangular fabric shell.

A further rendable line 116, scored in only one of the fabric layers, is separable to form the face opening in the hood portion, and rendable lines 118, 120, similarly scored in only one layer, can be separated to provide hand holes in the poncho.

Two additional rendable lines 122, 124, are sealed on both sides and extend, respectively, generally parallel to and spaced from shoulder segments 102, 104. The separation of lines 122, 124 creates a pair of oppositely disposed strips which can be used to tighten the hood about the head of a wearer. It should be noted that each strip includes both layers of the web and, in the preferred embodiment, undulations 126 and slits 128 can cooperate in the manner described above to permit hood adjustment without knot tying.

When serially connected in a roll in the manner illustrated in FIGS. 1 and 2, the garments are designed so that rendable lines (e.g., 18 and 68), which interconnect the successive garments, are more easily separated than are the scored lines (e.g., 30 and 70) which define the hood. Thus, when a garment is torn from the roll, it maintains the general rectangular shape of the shell, corner remnants 36, 38 and 96, 98 remaining in the positions shown until removed by separation along line 30 and 60, respectively, just prior to use.

Figure 5A:
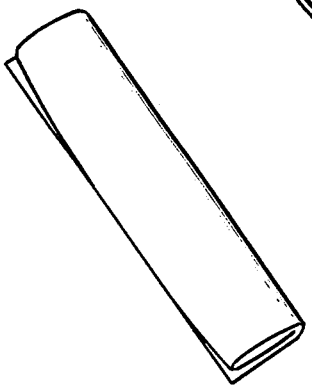
FIGS. 5A, 5B, and 5C illustrate the manner in which a separated garment can be folded into an attached pocket portion for carrying and storage prior to use.
Figure 5B:
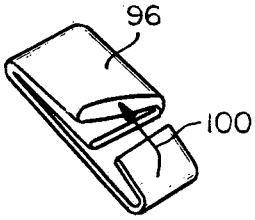
Figure 5C:
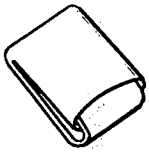

It should be noted that, in each embodiment, the corner remnants are open along their top edge and that the hood-forming line may be sealed along only one side (as is scored line 30) or it may be sealed along both sides (as is scored line 70). In the latter case, corner remnants 96, 98 form separable pocket portions, the layers of the web being sealed along all outside edges of the pocket portion except that formed by scored line 68. Such pocket portions can either be separated and used as a container for storing the garment, or they may remain attached and used for storage pockets into which the remainder of the shell can be folded and stuffed, as shown in FIGS. 5A, 5B and 5C. For instance, the garment can be folded over itself from one outside edge as shown in FIG. 5A, then folded upwardly from the bottom as in FIG. 5B, and then the folded portion can be stuffed into the pocket formed by remnant corner 96 as indicated by arrow 100. This permits the garment to be removed from the roll or package ahead of use, folded in the manner just described and stored in a neat packet, as shown in FIG. 5C, in a purse, pocket, golf bag, etc., until such time as use is required.

While both layers of material are illustrated as being similar, it is contemplated that one or both of them, or portions of them, might be coated with additional layers of other types of materials, e.g., absorbant, heat-reflective, etc., to provide additional protection to the wearer in accordance with the type of service to which the garment is being put.

It should also be appreciated that the garments shown could be packed in other manners than in a roll. They might be dispensed individually from a box or even packed individually.

What is claimed is:

1. A garment-forming blank comprising a shell of two layers of fabric sealed along two opposite outside edges, said layers also being sealed along at least one side of a scored and rendable line which intersects both said sealed outside edges and includes (a) two oppositely disposed shoulder segments, each extending inwardly from a respective one of said sealed outside edges, and (b) two head segments extending, respectively, from the inner ends of said shoulder segments and generally transverse thereto in a direction away from the sealed side of said scored line, said head segments joining in a crown so that the scored and sealed line forms a head-receiving hood portion and a lower portion for receiving and covering another part of the body of a wearer, and further comprising one other rendable line scored in only a first one of said layers and separable to form a face-opening in said hood portion.

2. The garment-forming blank of claim 1 wherein said lower portion comprises a further rendable line scored in said first layer, said further rendable line intersecting and extending from a further outside edge of said shell and being separable so that said lower portion forms a cape to cover the trunk of a wearer.

3. The garment-forming blank of claim 1 wherein said lower portion further comprises a pair of sealed and scored lines each intersecting a third outside edge of said shell and extending substantially parallel to a respective one of said sealed outside edges, said lines being closer to their respective sealed outside edges than to each other and being separable to form a pair of arm-receiving portions.

4. The garment-forming blank of claim 2 wherein said further scored and rendable line includes a plurality of segments separable to form closing means.

5. The garment-forming blank of claim 4 wherein said closing means comprises at least one strip of fabric attached to said trunk-receiving portion and having a free end.

6. The garment-forming blank of claim 5 wherein said one layer of the lower portion further comprises at least one slit through which a free end of said strip can be passed to close the lower portion around the trunk of a wearer.

7. The garment-forming blank of claim 1 wherein the other scored line forming said face-opening further comprises a plurality of segments separable to form at least one strip of fabric attached to said first layer of the hood portion and having a free end.

8. The garment-forming blank of claim 7 wherein said plurality of segments is separable to form a pair of oppositely disposed strips of fabric each attached to said first layer of the hood portion and each having a free end, the free ends of said strips being adaptable to be tied together to tighten the hood portion around the head of wearer.

9. The garment-forming blank of claim 7 wherein said hood portion further comprises at least one slit through which a free end of said strip can be passed to tighten the hood portion around the head of a wearer.

10. The garment-forming blank of claim 9 wherein said other scored line undulates along one segment thereof to form serrations along one edge of said strip.

11. The garment-forming blank of claim 1 wherein said two-layered shell is substantially rectangular and is sealed along both sides of said scored and rendable hood-forming line, and wherein the crown of said hood-forming line is coincident with an unsealed outside edge of the shell so that at least one separable pocket portion is formed between said hood-forming line and one corner of said shell.

12. The garment-forming blank of claim 11 adapted to be serially connected in a continuous web to similar garments comprising similar rectangular shells.

13. The garment-forming blank of claim 12 wherein said unsealed outside edge is formed by separation of a scored and rendable line which divides said garment from the next serially connected similar garment on said continuous web.

14. The garment-forming blank of claim 13 wherein the line separable to form said unsealed outside edge is more easily rendable than said hood-forming line.

15. The of claim 1 comprising at least one additional rendable line scored in at least one of said layers and separable to form hood-adjusting means for tightening said hood portion about the head of a wearer.

16. The garment-forming blank of claim 15 wherein said hood-adjusting means comprises two additional scored and rendable lines each sealed along both sides and extending generally parallel and spaced from a respective one of said shoulder segments of said hood-forming line, said additional lines separating to form a pair of opposed strips which can be tied under the chin of a wearer.

17. The garment-forming blank of claim 15 wherein said additional line is separable to form a strip attached to the garment and having one end free, and said hood-adjustment means further comprises a slit through which said strip can be passed.

18. The garment-forming blank of claim 17 wherein a portion of one line forming said attached strip undulates and is separable to form a serrated edge on said strip.

* * * * *